United States Patent [19]

Mishark et al.

[11] 4,147,440

[45] Apr. 3, 1979

[54] SLIDING CODE DISC READER AND DETENT THEREFOR FOR DUAL PITCH WEB FEEDING

[75] Inventors: Joseph E. Mishark, Rochester; Robert N. Peters; Kenneth S. Pyszel, both of Sterling Heights, all of Mich.

[73] Assignee: Computer Peripherals, Inc., Rochester, Mich.

[21] Appl. No.: 771,582

[22] Filed: Feb. 24, 1977

[51] Int. Cl.[2] ..... B41J 15/00

[52] U.S. Cl. ..... 400/611; 400/616.1

[58] Field of Search ..... 197/20, 133 R

[56] References Cited

U.S. PATENT DOCUMENTS

| | | | |
|---|---|---|---|
| 2,981,396 | 4/1961 | Lane | 197/133 R |
| 3,323,700 | 6/1967 | Epstein et al. | 197/133 R UX |
| 3,552,619 | 1/1971 | Skiba | 197/20 X |
| 3,643,039 | 2/1972 | Barcomb et al. | 197/133 R |
| 3,658,163 | 4/1972 | Sniderman | 197/133 R |
| 3,857,471 | 12/1974 | Hoffman et al. | 197/133 R |
| 3,888,340 | 6/1975 | Hoffman | 197/133 R |

OTHER PUBLICATIONS

IBM Technical Disclosure Bulletin, "Printer Paper Drive Mechanism," Mathurin et al., vol. 10, No. 3, Aug. 1967 p. 281.

*Primary Examiner*—Ernest T. Wright, Jr.
*Attorney, Agent, or Firm*—G. J. Muckenthaler; W. Hawk, Jr.; J. T. Cavender

[57] ABSTRACT

A code reader, in the form of a photoelectric sensing device, is slidable across a coded disc which disc includes a first circle of apertures at one diameter designating a code channel for advancing record media, for example, at a spacing of six lines per inch and a second circle of apertures at another diameter designating a code channel for advancing the record media at a spacing of eight lines per inch. A positive locking detent is associated with the code reader for maintaining the desired position thereof for the selected code channel and line spacing.

3 Claims, 6 Drawing Figures

SLIDING CODE DISC READER AND DETENT THEREFOR FOR DUAL PITCH WEB FEEDING

BACKGROUND OF THE INVENTION

In high speed printing equipment, it is common practice to provide means for advancing the record media, after the printing of each line, a distance or space of predetermined value so that all lines of printing are equally and precisely spaced. While various ways and means have been utilized for controlling record media advancement apparatus, viz. punched cards, tape loops, apertured discs and like elements, it is seen in the prior art the extensive use of multiple devices has been necessary to provide the required control of such apparatus. Representative prior art in the field of paper advancement mechanism in printers is shown in U.S. Pat. No. 3,673,957, issued on July 4, 1972 to J. Guzak, Jr., which discloses a printer including changeable code means wherein a reader reads a memory in the form of a code wheel having code elements therein. The reader includes light emitters and light sensing members, there being a first removable clip for one figure symbol and a second removable clip for another figure symbol. The set of code elements or holes formed in each clip is read by the light sensing members in the same manner as the code elements formed directly in the code wheel are read by the sensing members. U.S. Pat. No. 3,888,340 issued on June 10, 1975 to P. R. Hoffman discloses a variable pitch tapeless control system for controlling the pitch between printed lines and including a manually operated shift mechanism for selecting the desired one of a plurality of form lengths. Photocells and sensing devices are associated with the stepping motor and cooperate with logic circuitry in response to two different types of spacing instructions.

SUMMARY OF THE INVENTION

The present invention is directed to control of line spacing of paper in a printer and more particularly to the use of a code disc having a pair of channels represented by a first circle of apertures at one diameter and a second circle of apertures at another diameter for reading by a reader, thereby setting apparatus for advancing the paper at a spacing of six lines per inch when the reader is positioned to read one channel and at a spacing of eight lines per inch when the reader is positioned to read the other channel. The code disc is mounted on a servo motor output shaft, which motor also drives a tractor shaft for vertically advancing the paper at the desired spacing after the printing operation. Selection of the line spacing is accomplished by manually moving the reader unit in a vertical direction relative to and across a portion of the code disc, the reader including photoelectric sensing devices for observing and reading the selected circle of apertures. In the up position of the reader the six lines per inch channel is read, and in the down position the eight lines per inch channel is read. The reader includes a cam surface thereon operating with a spring-loaded plunger carried in the frame of the housing, which plunger seats in either one of two positions on the cam profile of the reader to provide a positive detent for maintaining the reader in the desired up or down position.

In accordance with the above discussion, the principal object of the present invention is to provide new and improved means for selecting line spacing of paper advancement.

Another object of the present invention is to provide a coded disc with channels thereon for reading by a reader in a selected position thereof.

An additional object of the present invention is to provide a reader unit slidable from one line spacing position to another line spacing position for selecting the desired line spacing.

A further object of the present invention is to provide means for positive locking of the reader unit in one or another position thereof.

Additional advantages and features of the present invention will become apparent and fully understood from a reading of the following description taken together with the annexed drawing, in which.

Figure 1:
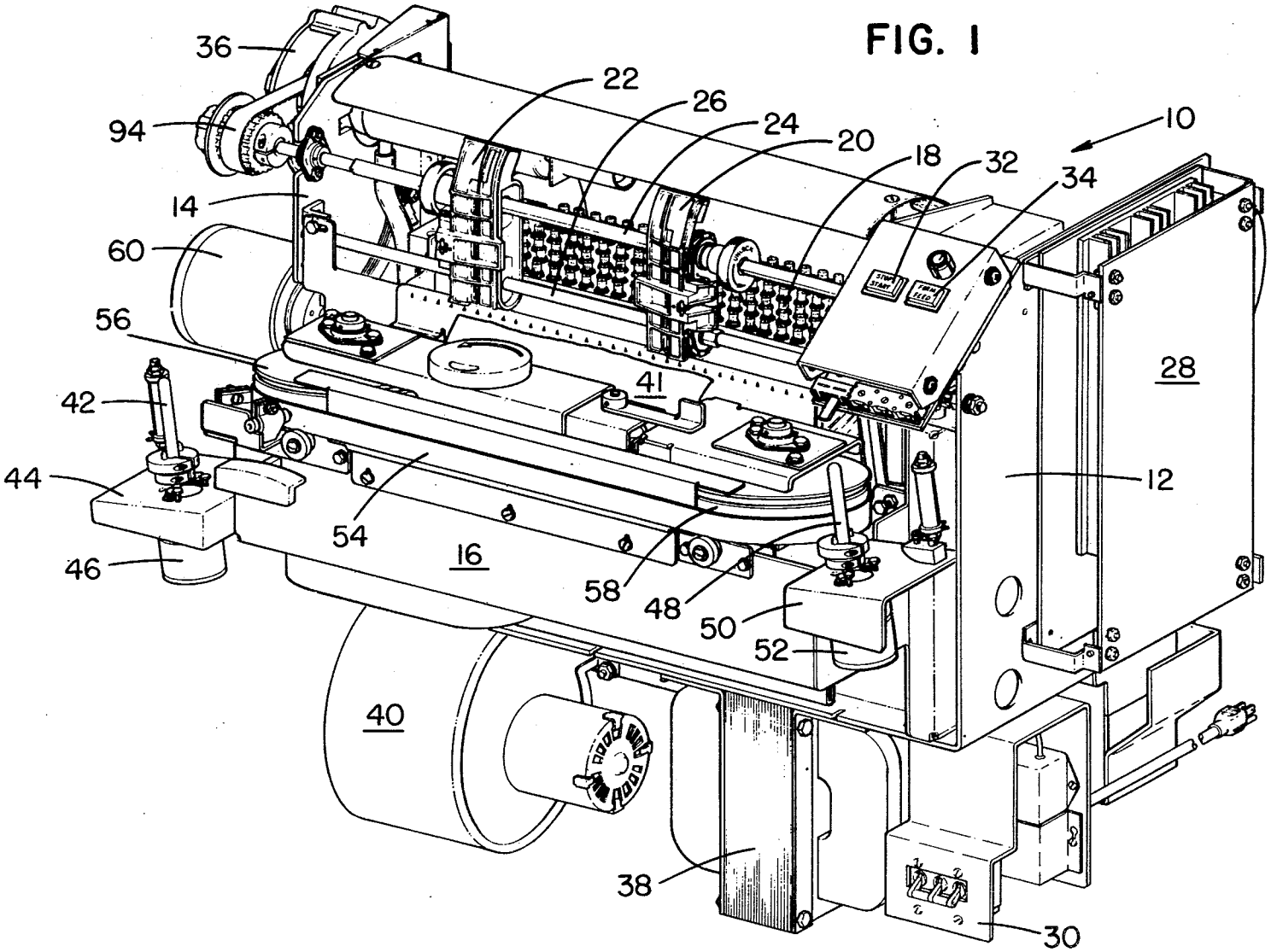
FIG. 1 is a right front perspective view of a portion of a printer incorporating the subject matter of the present invention.

As seen in FIG. 1, a printer 10 incorporating the subject matter of the present invention utilizes a band 54 for carrying the type characters thereon, such band printer distinguishing from a drum printer in a number of areas and features, the most significant area being the type carrying structure. The printer 10, of course, includes the framework of vertical side plates 12 and 14, which support the print band gate structure 16, the hammer bank 18, the paper forms tractors 20 and 22 carried on shafts 24 and 26, the power supply and servo drive 28, and other major parts which will later be explained in further detail. An on-off switch 30 is located at the lower right front of the printer 10, a start-stop switch 32 and a forms feed switch 34 are positioned on the top right front of the printer 10, and forms handling control mechanism 36 is located on the upper left side of the printer 10. A transformer 38 and a blower unit 40 are disposed under the gate structure 16, the blower unit 40 providing cooling to the various areas and parts of the printer 10.

Form paper or like record media 41 is caused to be driven or pulled by the tractors 20, 22 from a forms stack below the gate structure 16, upwardly past the printing station between a type band 54 and the hammer bank 18, and out an exit slot at the rear of the printer 10. A ribbon (not shown) is caused to be driven from a ribbon spool (not shown) rotatable on the spindle 42 which is supported on a frame member 44 and driven by a motor 46 located at the left side of the gate structure 16, the ribbon being guided in a path rearward of the gate structure 16 and onto a ribbon spool (not shown) rotatable on a further spindle 48 which is supported on a frame member 50 and driven by a motor 52 at the right side of the gate structure 16.

The print or type band 54 is caused to be driven in a counter-clockwise direction by the drive pulley 56, at the left side of the gate structure 16, and around a driven or idler pulley 58 located at the right side of the structure 16, the band 54 being directed in a path adjacent a platen (not shown) and past a print station and positioned to be impacted by print hammers aligned in a horizontal manner forward of the hammer bank 18. A hammer bank drive motor 60 is provided for driving or moving the hammer bank 18 in a horizontal direction for purposes not relevant to the subject matter of the present invention.

For purposes of information, the print band support mechanism, the tracking mechanism for the inking ribbon, and the paper forms clamping mechanism include structures which are the subject matter of copending applications, Ser. No. 886,328 filed Mar. 13, 1978 of J. R. Moss, continuation of Ser. No. 762,227 filed Jan.24, 1977, abandoned; Ser. No. 778,767 filed Mar. 17, 1977 of J. R. Moss, now U.S. Pat. No. 4,084,683; Ser. No. 778,766 filed Mar. 17, 1977 of J. R. Moss, now U.S. Pat. No. 4,091,912; respectively, and assigned to the same assignee as the present application.

Figure 2:
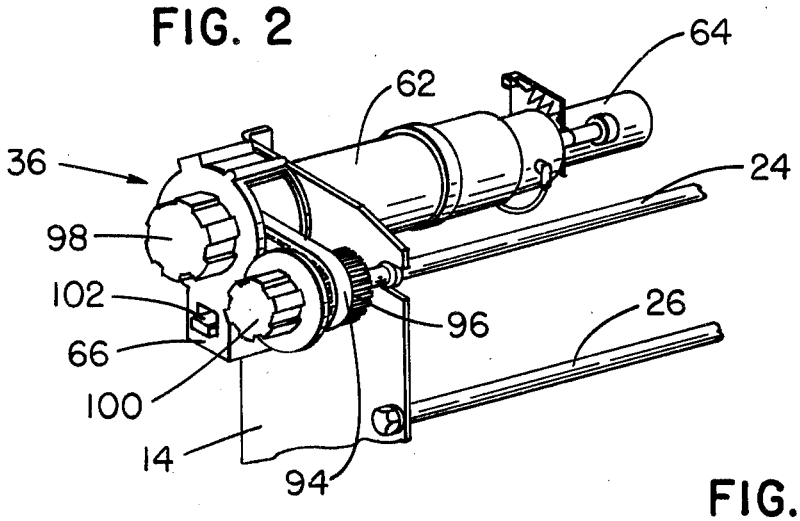
FIG. 2 is a left front perspective view of a portion of the structure shown in FIG. 1.
Figure 3:
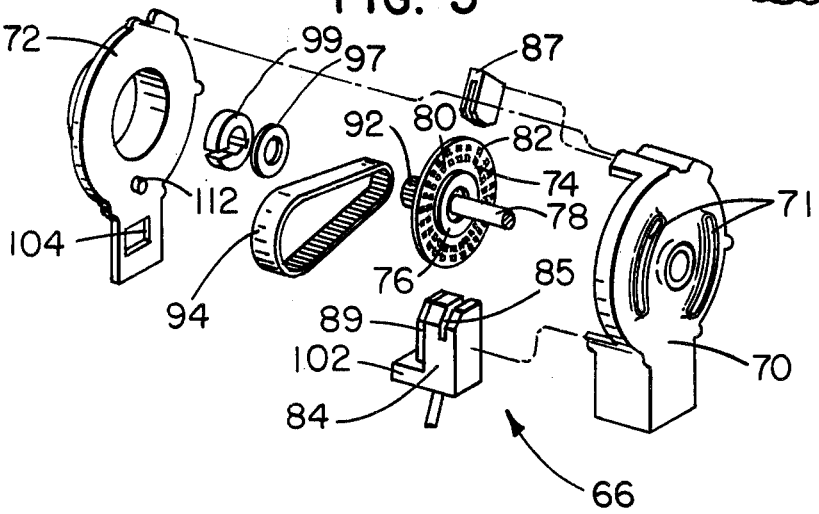
FIG. 3 is an exploded view of certain parts shown in FIG. 2.

In FIG. 2 is shown a view of the form paper handling control mechanism 36 supported from the side plate 14, such control mechanism 36 including a servo motor 62 connected with a tachometer 64, a format reader assembly 66, the forms tractors 20 and 22 (FIG. 1) carried on the shafts 24 and 26, forms position adjustment controls 98, 100 and an associated drive belt 94. The tachometer 64 transmits a speed reference signal to the control circuitry which monitors and controls the speed of the motor 62. FIG. 3 shows the housing for the line spacing controls of the form paper 41 which housing includes a right side portion 70 and a left side portion 72, the portions 70, 72 being rotatably movable on an output shaft 78 of the servo motor 62 and suitably connected with the side plate 14 to provide rotatable adjustment of the format reader assembly 66 therewith, such adjustment being made by use of the arcuate slots 71 in portion 70.

Figure 5:
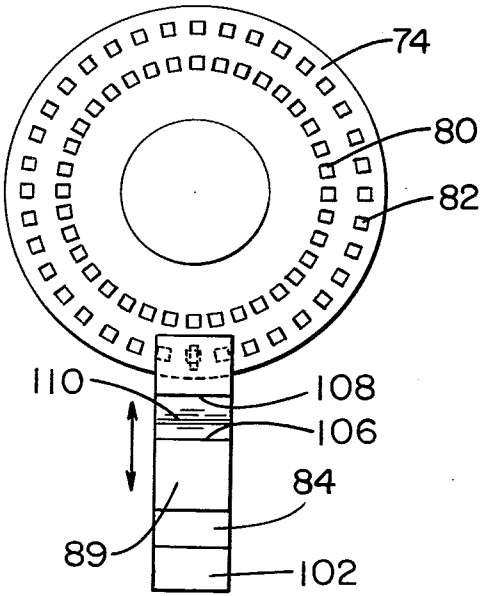
FIG. 5 is a detailed enlarged view of the code disc showing the channels therein and the reader unit positioned to read one channel.
Figure 4:
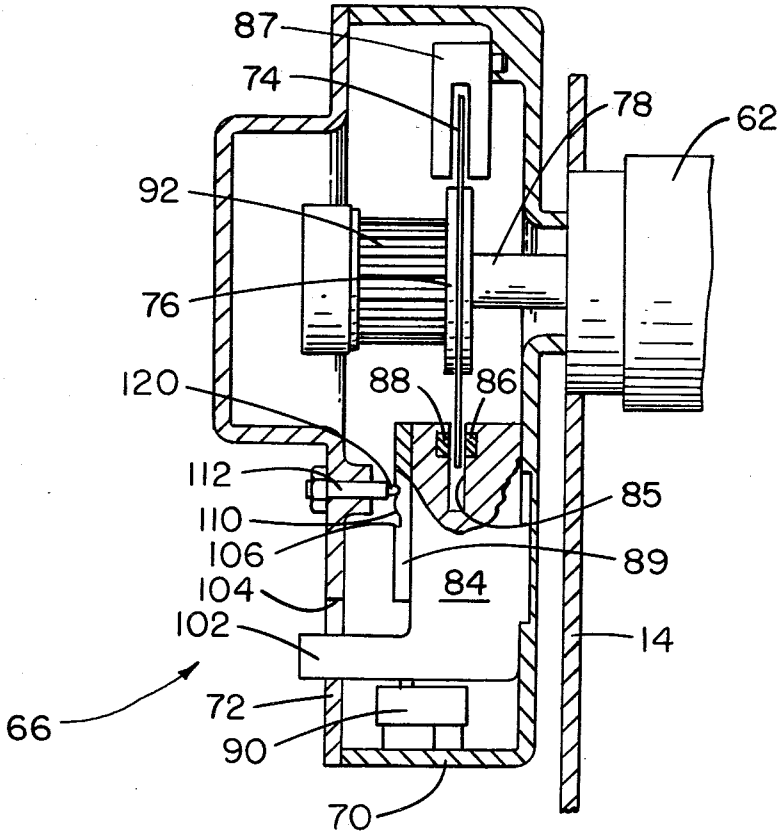
FIG. 4 is an enlarged elevational view, partly in section, showing the relative positions of the code disc, the reader unit, and associated parts.

A code disc 74 (FIGS. 3, 4 and 5) is secured to a hub 76 on the output shaft 78 of the servo motor 62, the disc 74 including a plurality of apertures 80 in a circle at a predetermined diameter from the axis of the disc 74 and a plurality of apertures 82 positioned in a circle at a greater diameter than the circle of apertures 80. The circle of apertures 82, being farther from the center of the disc 74 than the circle of apertures 80, are also spaced at a greater distance from each other. A reader unit 84, as a portion of the format reader assembly 66, is nested in the lower closure of housing right side portion 70, such reader unit 84 having a slot 85 therein for entry of the periphery of the code dics 74. The reader unit 84 is slidable up and down in a selection of two positions, FIGS. 4 and 5 showing the reader unit 84 in a lower position and reading the apertures 82 in the code disc 74 for spacing the printing at eight lines per inch. Photosensors 86 and 88 (FIG. 4) are included in the reader unit 84 on either side of the code disc 74 to read the spacing of the apertures 80 and 82 in the disc 74. In the upper position of the reader unit 84, the sensors 86 and 88 read the circle of apertures 80 for spacing the printing at six lines per inch. A microswitch 90 is positioned in the housing portion 70 at the lower side of the reader unit 84 to be actuated by the up and down motion of the reader unit 84 to change the line counter in the controller unit for either the six or eight lines per inch spacing.

A check strobe reader 87 spans the code disc 74 above the reader unit 84 and is slotted to permit entry of the periphery of the code disc 74. Such reader 87 senses rotation of the code disc 74 and indicates that the disc 74 has in fact rotated a certain angular distance and performs a fail-safe function.

The motor output shaft 78 also has secured thereto a pulley 92 (FIGS. 3 and 4) for supporting a timing belt 94 for driving the upper shaft 24 of the tractor drive mechanism by training of the belt 94 around a timing pulley 96 secured to the shaft 24, (FIG. 2). In this manner it is seen that the servo motor 62 drives the shaft 24 to advance the forms paper 41 in accordance with the six or eight lines per inch apertures 80 and 82 in the code disc 74 as selectively read by the reader unit 84. A washer 97 and a locking collar or clamp 99 are utilized, respectively, to provide a flange for one edge of the timing belt 94 and to secure the code disc assembly 74, 76 to the drive shaft 78.

The forms handling control mechanism 36 also includes a vernier adjustment control 98 (FIG. 2) for rotating the housing via the slots 71 in the housing portion 70 (FIG. 3) to allow minor adjustment to print line positioning on the forms paper 41. Additionally, a course positioning control 100 (FIG. 2) on the drive shaft 24 can be rotated to position the top of forms paper 41 correctly in relation to the print line.

Figure 6:
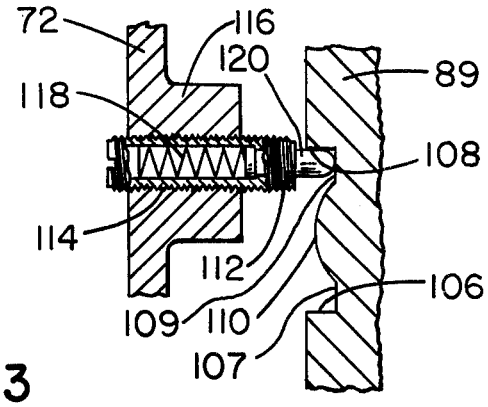
FIG. 6, on the sheet with FIGS. 2 and 3, is a detailed view of the detent means for the reader unit.

As seen in FIG. 4, the reader unit 84 is movable in such up and down motion by manually operating a lever portion 102 of the reader unit 84, which portion 102 protrudes through an opening 104 in the left side portion 72 of the housing. The reader unit 84 and such portion 72 of the housing include detent means for maintaining the reader unit 84 in one or the other reading position, the reader unit 84 having a plate 89 secured thereto and which has a pair of shoulders 106 and 108 (FIG. 6) formed on one side of respective recesses 107 and 109 with a cam surface 110 therebetween, and operating with a spring-loaded plunger device 112 carried in the wall of the left side portion 72 of the housing. As illustrated in FIG. 6, the plunger device 112 has a threaded wall portion 114 which screws into a bushing 116 of the housing portion 72 and encloses a spring 118 biased against a plunger 120 engageable with the surface of one shoulder 106 or the other shoulder 108 of the plate 89 of reader unit 84. The position of the reader unit 84 is positively maintained by the force on the plunger 120 in the recesses 107, 109 and against the shoulder surfaces 106 and 108 of the reader plate 89. When switching from one channel to the other channel on the code disc 74, the operator pushes, in the required direction, on the protruding lever portion 102 of the reader unit 84 to momentarily overcome the spring 118 force and to cam the reader unit 84 from one position to the other position, i.e., from six to eight lines or from eight to six lines per inch.

It is thus seen that herein shown and described is apparatus for reading a disc coded in a form identifiable for printing either six or eight lines per inch as dictated by the position of the reader unit. The apparatus enables the accomplishment of the objects and advantages mentioned above, and while only one embodiment of the invention has been disclosed herein, variations thereof may occur to those skilled in the art. It is contemplated that all such variations, not departing from the spirit and scope of the invention hereof, are to be construed in accordance with the following claims.

What is claimed is:

1. Means for controlling extent of advancement of record media comprising drive means, driven means connected with said drive means for advancing said record media incrementally in line spacing positions, code means comprising a rotatable disc member connected with said drive means for operation therewith and defining a plurality of code channels thereon, means sensing the rotation of said disc member, means including a slidable member slotted for receiving said disc member and movable across the face of said disc member for reading one or another of said plurality of code channels at any one time, switch means operable by movement of said slidable member for selection of a line spacing position, and means including camming means on said slidable member and a spring loaded plunger operable across a curved surface of said camming means for retaining said slidable member in one line spacing position or in another line spacing position while reading one or another of said code channels.

2. In a printer, means for advancing record media in one or another line spacing of printing thereon comprising:

drive means, a circular code disc member connected with said drive means for rotatable operation therewith and defining a plurality of apertured code channels therein, read means including a slidable member slotted for receiving said circular code disc member and movable across the outer portion of said circular code disc member for reading one or another of said plurality of apertured code channels at any one time, means sensing the rotation of said disc member, switch means actuated by movement of said slidable member for selection of a line spacing of printing, and camming means including a pair of spaced shoulders with a curved camming surface therebetween and a spring loaded plunger operable from one shoulder across said camming surface to the other shoulder for retaining said slidable member in one or another position while reading a selected code channel.

3. In a printer having a type character carrier, hammer means for impacting against type characters on said type character carrier, means for moving said type character carrier past said hammer means, and means for moving record media in a path between said hammer means and said type character carrier in one or another line spacing of printing thereon, said record media moving means including drive means, code means including a disc member having a plurality of code channels spaced from the axis of said disc member and connected with said drive means for rotation therewith, means sensing the rotation of said disc member, read means including a slidable member slotted for receiving the outer radial portion of said disc member in one position of said read means for reading a code on said disc member to cause said drive means to move said record media in one line spacing of printing and movable across the face of said disc member to another position for reading a different code on said disc member to cause said drive means to move said record media in a different line spacing of printing, camming means including a first recess in said slidable member and a spring loaded plunger engaging in said first recess for retaining said slidable member in one position for reading one of said codes on said disc member and a second recess in said slidable member spaced across a curved surface from said first recess for receiving said spring loaded plunger for retaining said slidable member in another position for reading another of said codes on said disc member, and switch means actuated in response to movement of said slidable member for selection of a line spacing of printing.

* * * * *